US011796964B2

(12) United States Patent
Hayashi

(10) Patent No.: US 11,796,964 B2
(45) Date of Patent: Oct. 24, 2023

(54) WATCH

(71) Applicant: Seiko Epson Corporation, Tokyo (JP)

(72) Inventor: Koki Hayashi, Shiojiri (JP)

(73) Assignee: SEIKO EPSON CORPORATION

( * ) Notice: Subject to any disclaimer, the term of this patent is extended or adjusted under 35 U.S.C. 154(b) by 150 days.

(21) Appl. No.: 17/402,766

(22) Filed: Aug. 16, 2021

(65) Prior Publication Data

US 2022/0050422 A1 Feb. 17, 2022

(30) Foreign Application Priority Data

Aug. 17, 2020 (JP) ..... 2020-137319

(51) Int. Cl.
*G04B 37/10* (2006.01)
*G04B 3/04* (2006.01)

(52) U.S. Cl.
CPC ..... *G04B 37/106* (2013.01); *G04B 3/048* (2013.01)

(58) Field of Classification Search
CPC ..... G04B 37/106; G04B 3/048; G04B 37/08; G04B 37/103; G04B 3/04; G04B 3/043; G04B 3/046; G04B 37/10; H01H 13/06; H01H 2013/066; H01H 2300/016; H01H 2231/028
See application file for complete search history.

(56) References Cited

U.S. PATENT DOCUMENTS 3,362,154 A * 1/1968 Perret ..... G04B 37/106 368/290
3,453,819 A * 7/1969 Simon ..... G04B 37/106 368/290
8,920,022 B2 * 12/2014 Ishida ..... G04B 37/106 368/320
2004/0256205 A1 * 12/2004 Oshio ..... G04B 3/048 200/43.13

FOREIGN PATENT DOCUMENTS

JP H11-092748 A 4/1999
JP 2004-319446 A 11/2004
JP 2016-011860 A 1/2016

* cited by examiner

*Primary Examiner* — Edwin A. Leon
(74) *Attorney, Agent, or Firm* — Harness, Dickey & Pierce, P.L.C.

(57) ABSTRACT

A watch including: a case including a through hole formed in a side surface of the case; a cylindrical member which is an integral body formed of a first cylindrical portion being threadedly engageable with the through hole and a second cylindrical portion in contact with the side surface of the case and having a recessed housing portion which opens to the outside of the case, and has an insertion hole continuously formed with the recessed housing portion; an operating member which has a shaft portion being inserted into the insertion hole of the cylindrical member in a slidable manner, and a head portion being formed on an end portion of the shaft portion and housed in the recessed housing portion; and a sealing member which is disposed between the case and the second cylindrical portion.

4 Claims, 5 Drawing Sheets

WATCH

The present application is based on, and claims priority from JP Application Serial Number 2020-137319, filed Aug. 17, 2020, the disclosure of which is hereby incorporated by reference herein in its entirety.

BACKGROUND

1. Technical Field

The disclosure relates to a watch.

2. Related Art

JP-A-2016-11860 discloses a watch provided with a push-button switch. In the watch disclosed in JP-A-2016-11860, the push-button switch include: a cylindrical member which is mounted in a through hole formed in a wrist watch case and protrudes to the outside of the wrist watch case; a button member which is inserted into the cylindrical member in a slidable manner; and a coil spring which biases the button member toward the outside of the wrist watch case.

The cylindrical member includes: a first cylindrical portion which has male threads formed on an outer peripheral surface thereof and is mounted in the through hole of the wrist watch case; and a second cylindrical portion which is mounted on an outer surface of the wrist watch case by the first cylindrical portion, and a waterproof ring is disposed on the outer peripheral surface of the first cylindrical portion.

Further, the cylindrical member is configured such that when the male threads of the first cylindrical portion are threadedly engaged in the through hole of the wrist watch case, the waterproof ring is brought into pressure contact with an inner surface of a pressing portion of the first cylindrical portion and the outer surface of the wrist watch case, and the waterproof ring is also brought into pressure contact with an inner peripheral surface of a mounting protruding portion of the second cylindrical portion and an outer peripheral surface of a first body portion of the first cylindrical portion. With such a configuration, in JP-A-2016-11860, waterproofing is provided between an inner peripheral surface of the through hole of the wrist watch case and the outer peripheral surface of the first cylindrical portion can be achieved.

In JP-A-2016-11860, the mounting protruding portion of the second cylindrical portion and the waterproof ring are configured to have substantially the same thickness. Therefore, by mounting the cylindrical member in the through hole such that the mounting protruding portion and the waterproof ring are sandwiched between the pressing portion of the first cylindrical portion and the outer peripheral surface of the case, the waterproof ring is appropriately compressed so that waterproofing can be acquired.

However, for example, in a case where the thickness of the mounting protruding portion becomes larger than expected due to a tolerance, a gap is formed between the pressing portion of the first cylindrical portion and the waterproof ring. In such a case, the waterproof ring cannot be sufficiently sandwiched between the pressing portion and the outer peripheral surface of the case and hence, there is a drawback that the waterproof ring is not appropriately compressed so that sufficient sealing performance cannot be acquired.

SUMMARY

A watch according to the present disclosure includes: a case including a through hole formed in a side surface of the case; a cylindrical member which is an integral body formed of a first cylindrical portion being threadedly engageable with the through hole and a second cylindrical portion in contact with the side surface of the case and having a recessed housing portion which opens to the outside of the case, and has an insertion hole continuously formed with the recessed housing portion; an operating member which has a shaft portion being inserted into the insertion hole of the cylindrical member in a slidable manner, and a head portion being formed on an end portion of the shaft portion and housed in the recessed housing portion; and a sealing member which is disposed between the case and the second cylindrical portion.

DESCRIPTION OF EXEMPLARY EMBODIMENTS

Embodiments

Hereinafter, a watch 1 according to one embodiment of the present disclosure is described with reference to drawings.

Figure 1:
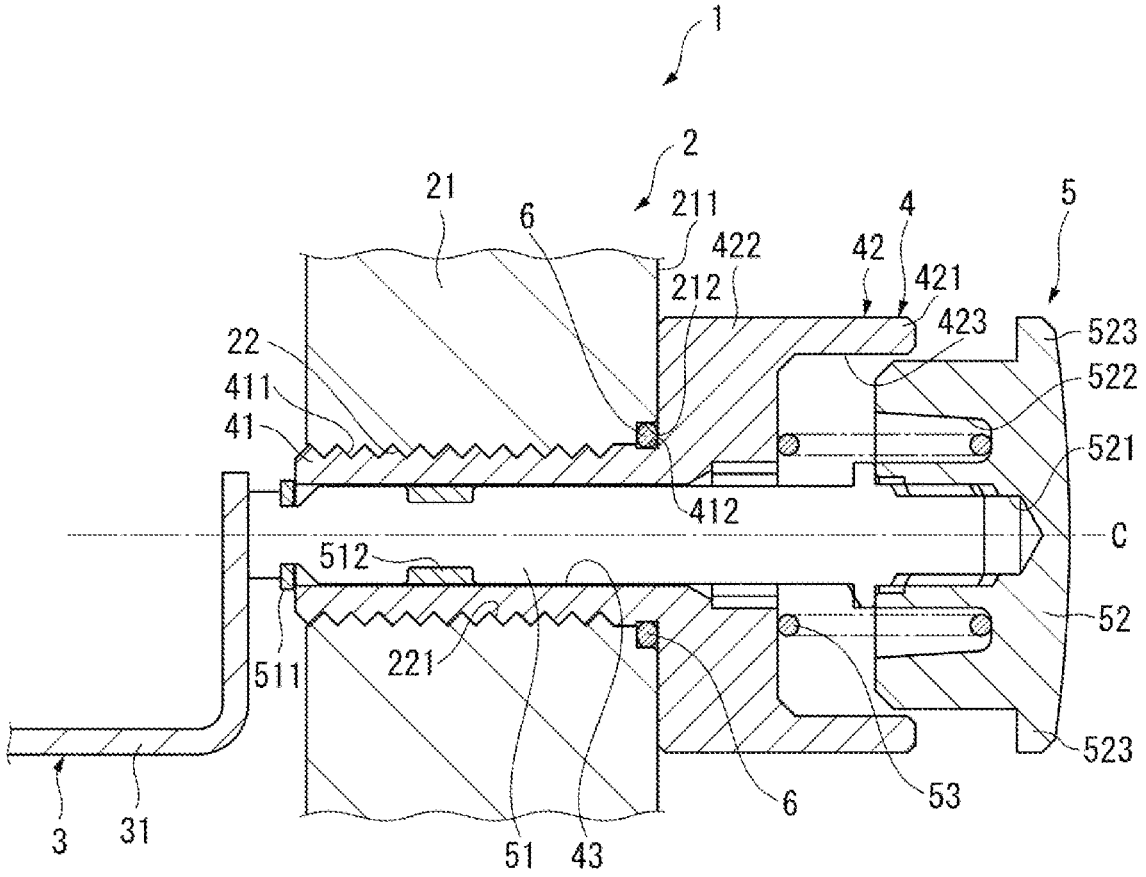
FIG. 1 is a cross-sectional view illustrating a main portion of a watch according to one embodiment.
Figure 2:
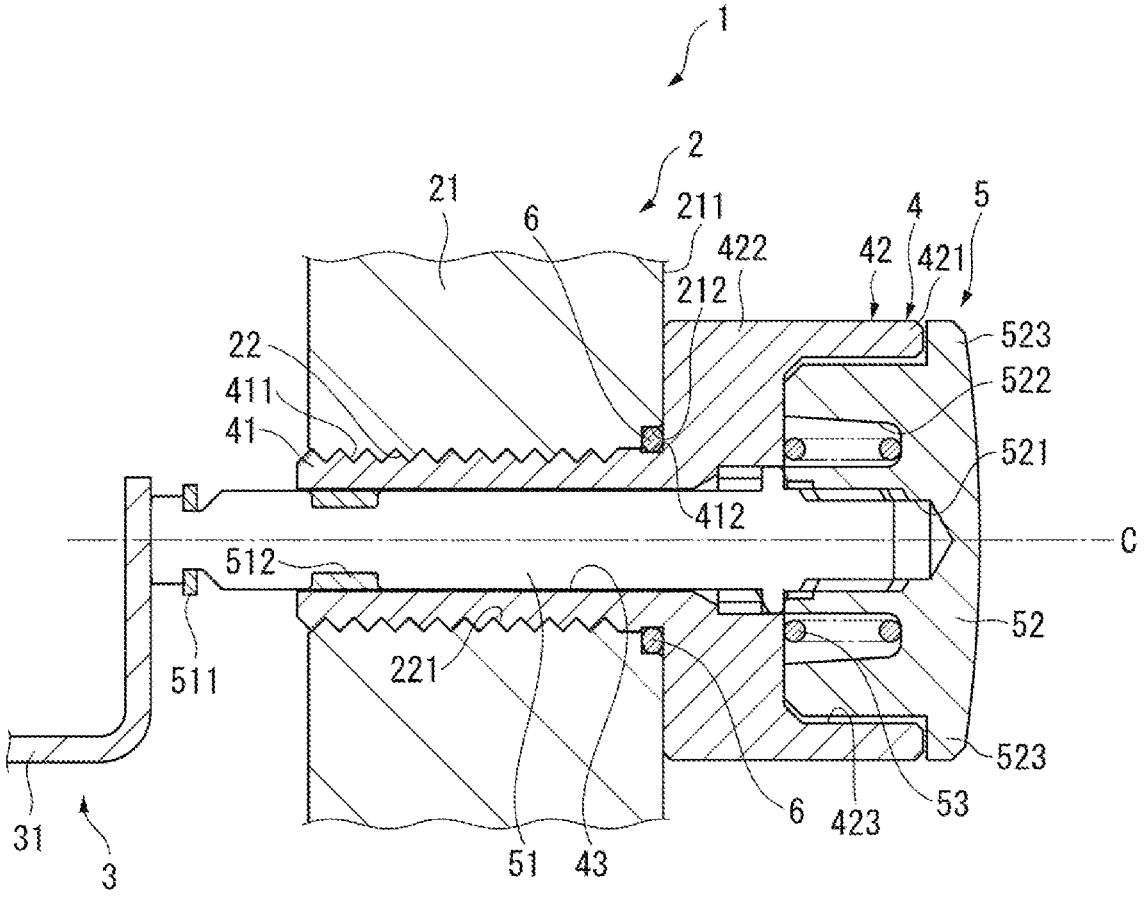
FIG. 2 is a cross-sectional view illustrating the main portion of the watch according to one embodiment.

FIG. 1 and FIG. 2 are cross-sectional views illustrating a main portion of the watch 1 according to the present embodiment. Here, FIG. 1 is a view illustrating the watch 1 in a state where an operating member 5 is not pushed in, and FIG. 2 is a view illustrating the watch 1 in a state where the operating member 5 is pushed in.

As illustrated in FIG. 1 and FIG. 2, the watch 1 includes a case 2, a movement 3, a cylindrical member 4, the operating member 5, and a sealing member 6.

The case 2 includes a circular cylindrical case body 21, and a back lid, a bezel, a glass plate, and the like which are not illustrated. A through hole 22 penetrating through the inside and outside of the case body 21 is formed in a side surface 211 of the case body 21. A female threaded portion 221 is formed at an inner peripheral surface of the through hole 22. Further, on the side surface 211 of the case body 21, a recessed portion 212 in which the sealing member 6 is disposed along an outer periphery of the through hole 22 is formed. In the present embodiment, the recessed portion 212 is formed such that a portion of the sealing member 6 protrudes from the side surface 211 of the case body 21 when the sealing member 6 is disposed in the recessed portion 212.

The movement 3 is housed in the case body 21. Further, the movement 3 is provided with a switch spring 31 which is operated by the operating member 5, and a detection electrode (not illustrated) which detects a button push input when the switch spring 31 is brought into contact with the detection electrode.

In the present embodiment, when the operating member 5 is pushed in (see FIG. 2), the switch spring 31 which is brought into contact with a distal end of the operating member 5 moves toward the inside of the case body 21. With such an operation, the switch spring 31 is brought into contact with the detection electrode not illustrated.

Cylindrical Member

Figure 3:
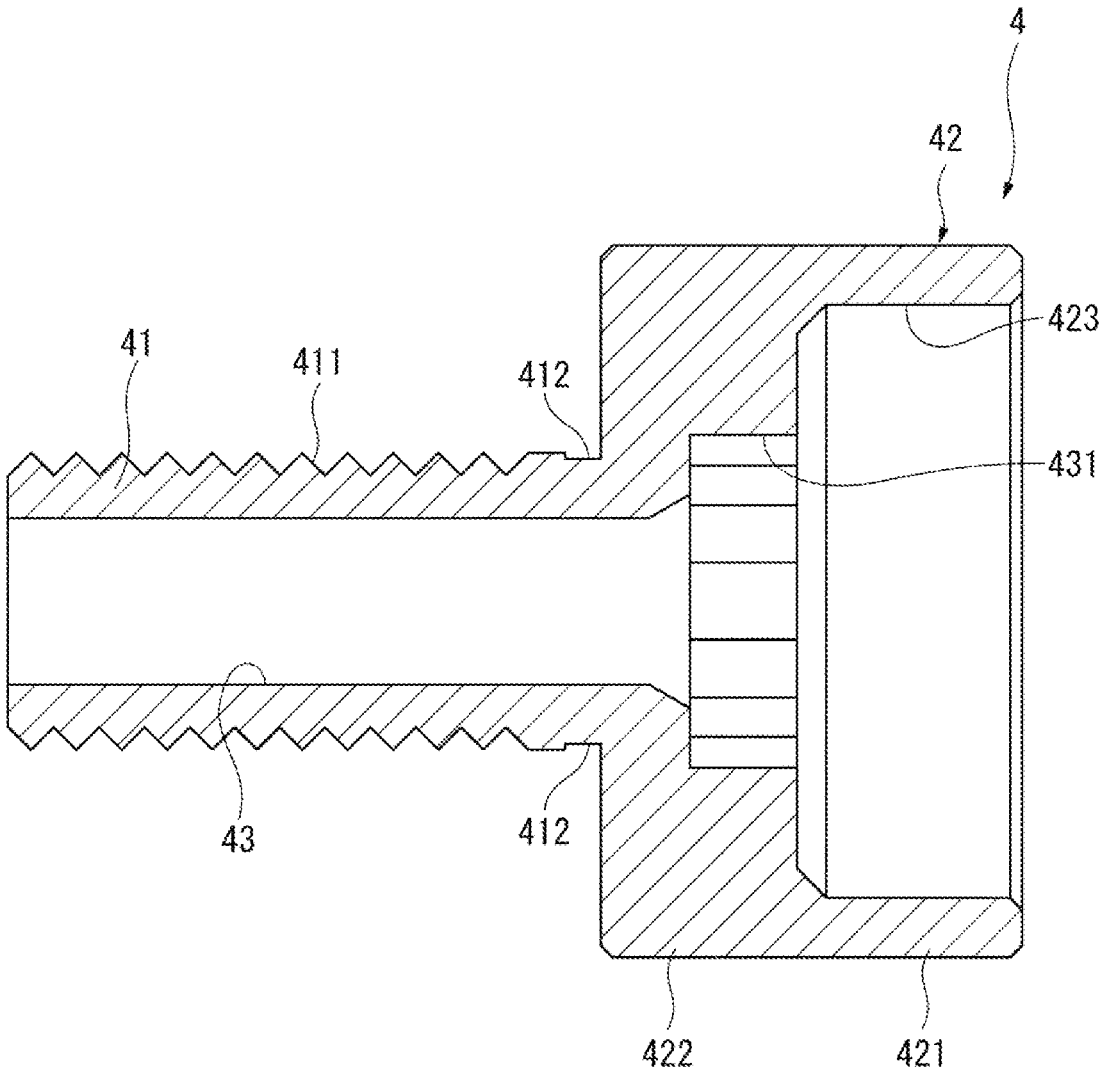
FIG. 3 is a cross-sectional view illustrating a cylindrical member.
Figure 4:
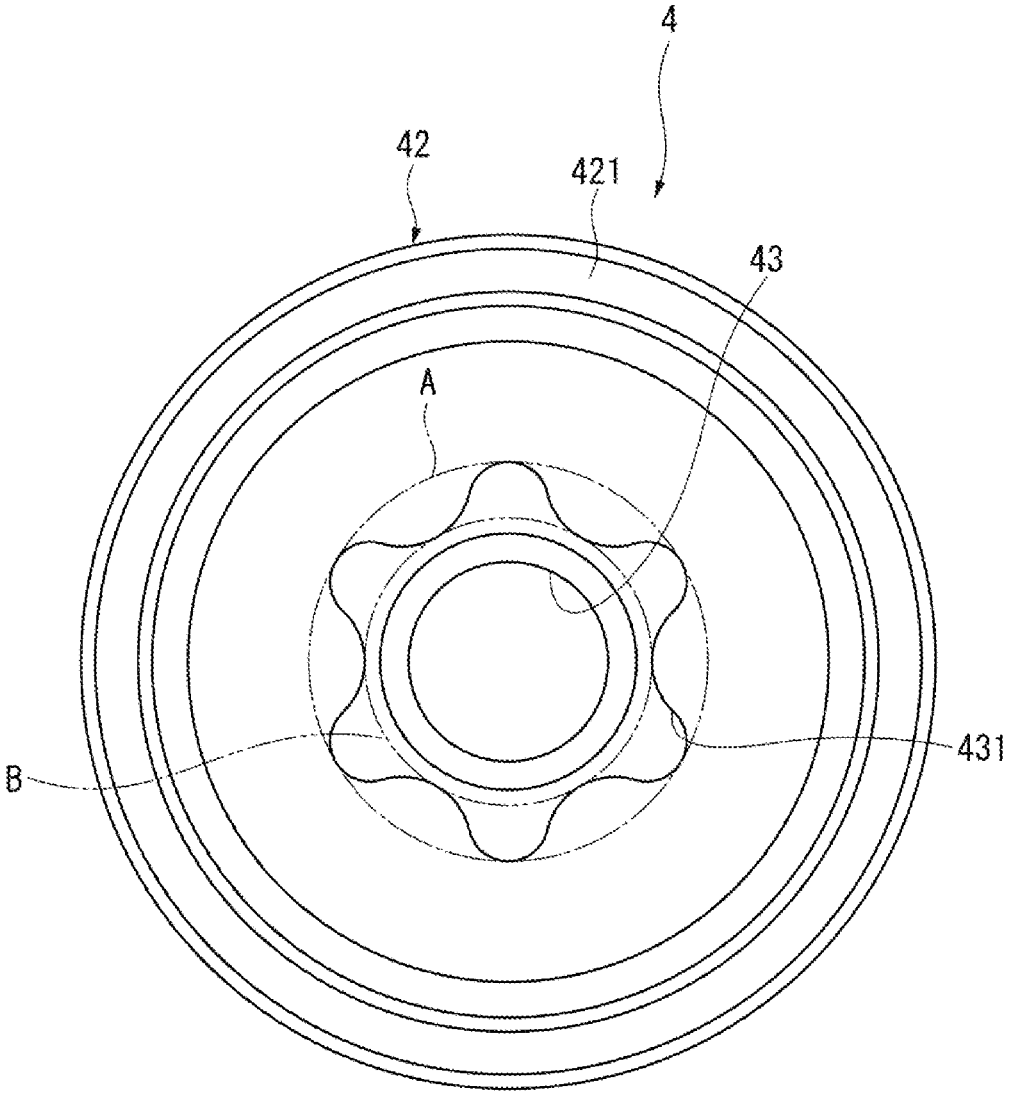
FIG. 4 is a front view illustrating the cylindrical member.
Figure 5:
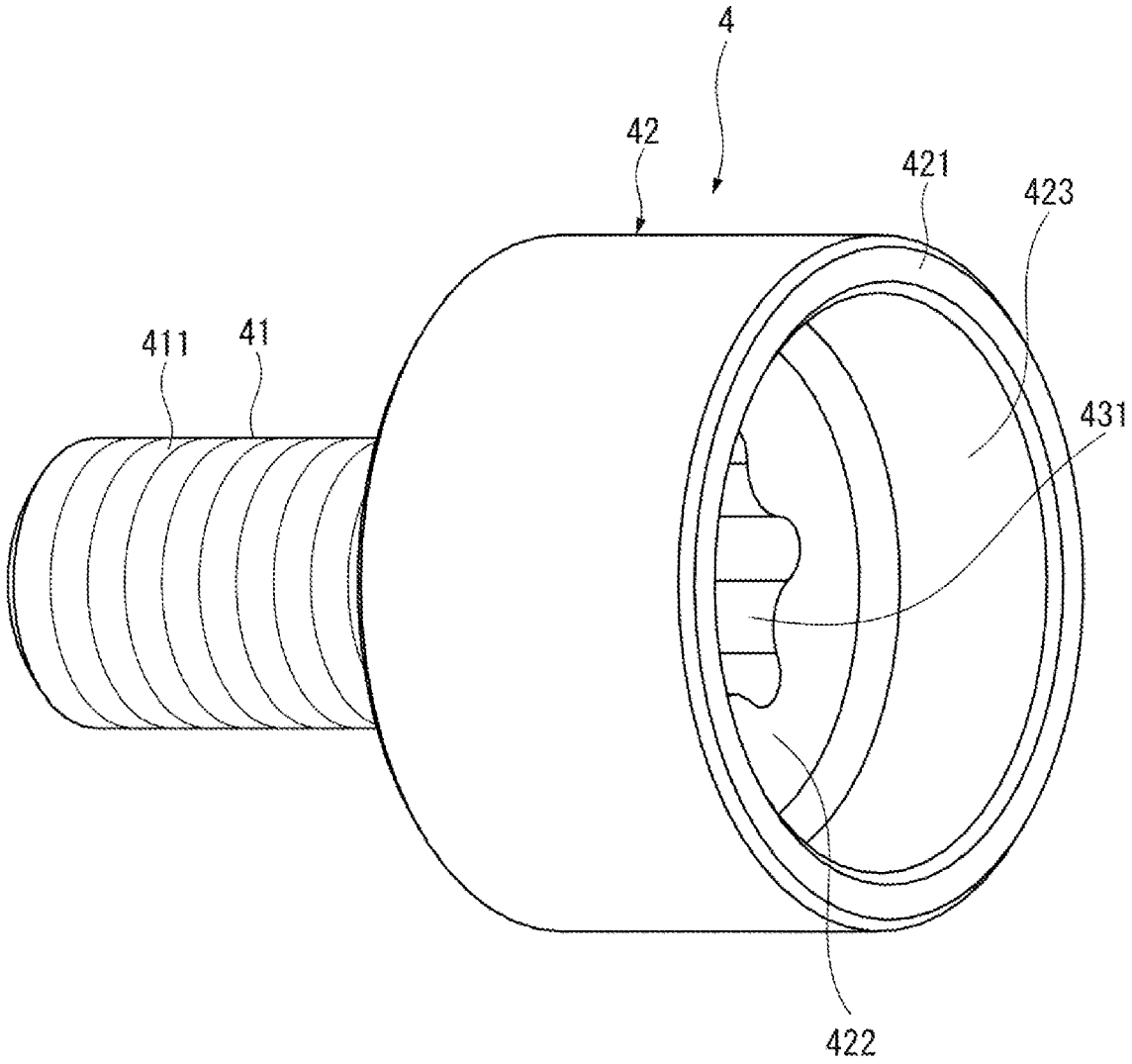
FIG. 5 is a perspective view illustrating the cylindrical member.

FIG. 3 is a cross-sectional view illustrating the cylindrical member 4, FIG. 4 is a front view illustrating the cylindrical member 4, and FIG. 5 is a perspective view illustrating the cylindrical member 4.

As illustrated in FIG. 1 to FIG. 5, the cylindrical member 4 includes a first cylindrical portion 41 and a second cylindrical portion 42 which form an integral body, and an insertion hole 43 is formed on an inner peripheral side of the cylindrical member 4.

The first cylindrical portion 41 has a circular cylindrical shape, and a male threaded portion 411 is formed on an outer peripheral surface of the first cylindrical portion 41. Further, the male threaded portion 411 is threadedly engageable with the female threaded portion 221 of the through hole 22. With such a configuration, the cylindrical member 4 is detachably mounted in the through hole 22 of the case body 21.

Further, on an end portion of the first cylindrical portion 41 on a second cylindrical portion 42 side, a recessed portion 412 in which the sealing member 6 is disposed is formed on the outer peripheral surface of the end portion. Here, the recessed portion 412 is formed such that the recessed portion 412 faces the recessed portion 212 of the case body 21 when the first cylindrical portion 41 is threadedly engaged in the through hole 22.

The second cylindrical portion 42 includes a circular cylindrical portion 421 and a bottom portion 422. The circular cylindrical portion 421 has a larger diameter than the first cylindrical portion 41. The bottom portion 422 is formed on an end portion of the circular cylindrical portion 421 on a first cylindrical portion 41 side, and is configured to be brought into contact with the side surface 211 of the case 2 when the first cylindrical portion 41 is threadedly engaged in the through hole 22 of the case 2.

Further, a recessed housing portion 423 which is defined by the circular cylindrical portion 421 and the bottom portion 422 and opens to the outside of the case 2 is formed on the second cylindrical portion 42. The recessed housing portion 423 is capable of housing a head portion 52 of the operating member 5 described later.

The insertion hole 43 is formed across the first cylindrical portion 41 and the second cylindrical portion 42, and is continuously formed with the recessed housing portion 423. That is, the insertion hole 43 is formed so as to penetrate the bottom portion 422 of the second cylindrical portion 42, and allows the insertion of a shaft portion 51 of the operating member 5 described later. In the insertion hole 43, an engaged portion 431 engageable with a tool is formed at an inner peripheral surface connected to the recessed housing portion 423.

In the present embodiment, the engaged portion 431 is a hexalobular hole engageable with a hexalobular wrench or the like. Accordingly, by engaging the hexalobular wrench with the engaged portion 431 formed as the hexalobular hole, the male threaded portion 411 of the first cylindrical portion 41 can be threadedly engaged with or disengaged from the female threaded portion 221 of the through hole 22. At this time, since the engaged portion 431 is the hexalobular hole, the engaged portion 431 is not engaged with a generally easily available driver or the like. Accordingly, it is possible to suppress the occurrence of a case where a user easily removes the cylindrical member 4, and damages or loses the cylindrical member 4.

Further, in the present embodiment, the engaged portion 431 is usually not exposed to the outside because the engaged portion 431 is covered by the head portion 52 of the operating member 5 described later. Accordingly, it is possible to prevent the design of the watch 1 from being impaired due to the exposure of the engaged portion 431.

Operating Member

The operating member 5 is configured as a so-called button member which can be operated by a user, and includes the shaft portion 51, the head portion 52, and a coil spring 53.

The shaft portion 51 is inserted into the insertion hole 43 of the cylindrical member 4, and is slidable along a central axis C. In the present embodiment, an end portion of the shaft portion 51 on a distal end side protruding to the inside of the case 2 is brought into contact with the switch spring 31, and an end portion of the shaft portion 51 on a proximal end side is mounted on the head portion 52.

A stop ring 511 is mounted on the distal end side of the shaft portion 51. For example, the stop ring 511 is formed of an E ring, and is configured to prevent the removal of the operating member 5 by in contact with an end surface of the first cylindrical portion 41.

Further, a waterproof sealing member 512 is disposed between the shaft portion 51 and the insertion hole 43.

The head portion 52 is a circular columnar member which is operated by a user, and is housed in the recessed housing portion 423 of the second cylindrical portion 42 described above. In the present embodiment, on the head portion 52, a shaft mounting portion 521, a coil spring arrangement portion 522, and an enlarged diameter portion 523 are formed.

The shaft mounting portion 521 is formed of a recessed portion formed on an end surface of the head portion 52 on a case 2 side, and an end portion of the shaft portion 51 on the proximal end side is mounted on the shaft mounting portion 521.

The coil spring arrangement portion 522 is formed of an annular-shaped groove portion, and one end portion of the coil spring 53 is disposed in the coil spring arrangement portion 522.

The enlarged diameter portion 523 is formed by extending an end portion of the head portion 52 on a side opposite to the case 2 in a radially outward direction. In the present embodiment, when viewed in an axial direction of the cylindrical member 4, an end surface of the circular cylindrical portion 421 of the second cylindrical portion 42 is covered by the enlarged diameter portion 523 of the head portion 52. With such a configuration, a gap between the second cylindrical portion 42 and the head portion 52 is concealed by the enlarged diameter portion 523 and hence, it is possible to prevent the design of the watch 1 from being impaired by the gap.

The coil spring 53 is formed of a so-called coil spring, allows the shaft portion 51 to pass therethrough, and is disposed between the bottom portion 422 of the second cylindrical portion 42 and the coil spring arrangement portion 522 of the head portion 52. Further, the coil spring 53 biases the operating member 5 toward the outside of the case 2. Accordingly, when the user releases pushing of the head portion 52 of the operating member 5 after the user pushes the head portion 52 (see FIG. 2), the operating member 5 can return to a state before being pressed (see FIG. 1).

In the present embodiment, the coil spring 53 is configured such that an inner diameter of the coil spring 53 is larger than an outer diameter A of the engaged portion 431 illustrated by a chain line in FIG. 4. With such a configuration, it is possible to suppress the occurrence of a phenomenon that a portion of the coil spring 53 is fitted in the engaged portion 431 thus causing a defect.

Sealing Member

The sealing member 6 is formed of a seal member such as a so-called O ring. In the present embodiment, the sealing member 6 is disposed in the recessed portion 212 of the case body 21 and the recessed portion 412 of the first cylindrical portion 41. With such a configuration, when the male threaded portion 411 of the first cylindrical portion 41 is threadedly engaged with the female threaded portion 221 of the through hole 22, the sealing member 6 is appropriately compressed by a surface of the recessed portion 212 of the case body 21 which faces the bottom portion 422 and a surface of the bottom portion 422 of the second cylindrical portion 42 which faces the case body 21. Accordingly, sealing is provided between the cylindrical member 4 and the through hole 22 and hence, it is possible to suppress the intrusion of moisture into the case 2.

Here, assume a configuration where the first cylindrical portion and the second cylindrical portion are formed as separate members, and the second cylindrical portion is assembled to the first cylindrical portion, when a size of a mounting portion of the second cylindrical portion with respect to the first cylindrical portion becomes larger than expected, there is a concern that a gap is formed between the first cylindrical portion and the sealing member. In this case, the sealing member cannot be appropriately compressed by the first cylindrical portion and hence, there is a concern that a sufficient sealing performance cannot be acquired.

On the other hand, in the present embodiment, the first cylindrical portion 41 and the second cylindrical portion 42 form an integral body, and the bottom portion 422 of the second cylindrical portion 42 is brought into contact with the side surface 211 of the case 2. Accordingly, even if a thickness of the bottom portion 422 becomes larger than expected due to the tolerance, there is no possibility that a gap is formed between the first cylindrical portion 41 and the second cylindrical portion 42 and the sealing member 6 and hence, there is no possibility that the sealing member 6 is not compressed appropriately. As a result, the number of parts can be reduced and, further, it is possible to suppress the occurrence of a case that a sufficient sealing performance cannot be acquired since the sealing member 6 is not compressed appropriately.

Manner of Operation and Advantageous Effects of Embodiment

According to the present embodiment, the following advantageous effects can be produced.

In the present embodiment, the first cylindrical portion 41 and the second cylindrical portion 42 are formed as an integral body, and the bottom portion 422 of the second cylindrical portion 42 is brought into contact with the side surface 211 of the case 2. With such a configuration, even if the thickness of the bottom portion 422 becomes larger than expected due to the tolerance, there is no possibility that the sealing member 6 is not compressed appropriately. As a result, the number of parts can be reduced and, further, it is possible to suppress the occurrence of a case that a sufficient sealing performance cannot be acquired since the sealing member 6 is not compressed appropriately.

In the present embodiment, the engaged portion 431 engageable with a tool is formed on the inner peripheral surface of the insertion hole 43 of the cylindrical member 4 and hence, by engaging the tool with the engaged portion 431, the first cylindrical portion 41 can be threadedly engaged in or disengaged from the through hole 22. Further, the engaged portion 431 is covered by the head portion 52 of the operating member 5 and hence, it is possible to prevent the design of the watch 1 from being impaired due to the exposure of the engaged portion 431.

In the present embodiment, an inner diameter of the coil spring 53 is larger than the outer diameter A of the engaged portion 431. Accordingly, it is possible to suppress the occurrence of a phenomenon that a portion of the coil spring 53 is fitted in the engaged portion 431 thus causing a defect.

In the present embodiment, the engaged portion 431 is formed of the hexalobular hole and hence, it is possible to suppress the occurrence of a case where a user easily removes the cylindrical member 4, and damages or loses the cylindrical member 4.

Modification Example

Here, the present disclosure is not limited to the embodiment described above, and variations, modifications, and the like within the scope in which the object of the present disclosure can be achieved are included in the present disclosure.

In the embodiment described above, although the inner diameter of the coil spring 53 is larger than the outer diameter A of the engaged portion 431, the present disclosure is not limited to such a configuration. For example, the coil spring 53 may be configured such that an outer diameter of the coil spring 53 is smaller than an inner diameter B of the engaged portion 431 indicated by a double-dashed chain line in FIG. 4. With such a configuration, the end portion of the coil spring 53 can be housed in the engaged portion 431 and hence, a protruding amount of the head portion 52 of the operating member 5 from the recessed housing portion 423 of the second cylindrical portion 42 can be decreased. Accordingly, the watch 1 can be miniaturized.

Further, the coil spring 53 may be configured such that the outer diameter of the coil spring 53 is smaller than the outer diameter A of the engaged portion 431, and the inner diameter of the coil spring 53 is larger than the inner diameter B of the engaged portion 431.

In the embodiment described above, although the engaged portion 431 is formed of the hexalobular hole, the present disclosure is not limited to such a configuration. For example, the engaged portion may be formed of a square hole or a hexagonal hole, and it is sufficient that the engaged portion is configured to be engageable with a tool.

In the embodiment described above, although the enlarged diameter portion 523 is formed on the head portion 52 of the operating member 5, the present disclosure is not limited to such a configuration. The present disclosure also includes a mode where the enlarged diameter portion is not formed on the head portion, for example.

In the embodiment described above, although the recessed portion 212 is formed on the side surface 211 of the case body 21 and the recessed portion 412 is formed in the first cylindrical portion 41, the present disclosure is not limited to such a configuration. For example, a recessed portion in which a sealing member is to be disposed may be formed on the bottom portion of the second cylindrical portion at a position which is where the bottom portion is continuous with the outer peripheral surface of the first cylindrical portion.

In the embodiment described above, although the cylindrical member 4 is constituted as a member in which the operating member 5 as a button member is inserted, the present disclosure is not limited to such a configuration. For example, the cylindrical member may be configured to allow the insertion of an operating member such as a crown.

Summary of the Present Disclosure

A watch according to the present disclosure includes: a case including a through hole formed in a side surface of the case; a cylindrical member which is an integral body formed of a first cylindrical portion being threadedly engageable with the through hole and a second cylindrical portion in contact with the side surface of the case and having a recessed housing portion which opens to the outside of the case, and has an insertion hole continuously formed with the recessed housing portion; an operating member which has a shaft portion being inserted into the insertion hole of the cylindrical member in a slidable manner, and a head portion being formed on an end portion of the shaft portion and housed in the recessed housing portion; and a sealing member which is disposed between the case and the second cylindrical portion.

With such a configuration, even if the thickness of the second cylindrical portion becomes larger than expected due to the tolerance, there is no possibility that the sealing member is not compressed appropriately. As a result, the number of parts can be reduced and, further, it is possible to suppress the occurrence of a case that the sufficient sealing performance cannot be acquired since the sealing member is not compressed appropriately.

In the watch of the present disclosure, the engaged portion engageable with a tool may be formed on the inner peripheral surface of the insertion hole, and the engaged portion may be covered by the head portion.

With such a configuration, by engaging the tool with the engaged portion, the first cylindrical portion can be threadedly engaged in or disengaged from the through hole. Further, the engaged portion is covered by the head portion of the operating member and hence, it is possible to prevent the design of the watch from being impaired due to the exposure of the engaged portion.

The watch of the present disclosure may be configured to include the coil spring through which the shaft portion is inserted, the coil spring being disposed between the second cylindrical portion and the head portion, and configured to bias the operating member toward the outside of the case, where the inner diameter of the coil spring may be larger than the outer diameter of the engaged portion.

With such a configuration, it is possible to suppress the occurrence of a phenomenon that a portion of the coil spring is fitted in the engaged portion thus causing a defect.

The watch of the present disclosure may be configured to include the coil spring the coil spring, the coil spring being disposed between the second cylindrical portion and the head portion, and bias the operating member toward the outside of the case, where the outer diameter of the coil spring may be smaller than the inner diameter of the engaged portion.

With such a configuration, the end portion of the coil spring can be housed in the engaged portion and hence, the watch can be miniaturized.

In the watch of the present disclosure, the engaged portion may be a hexalobular hole.

Accordingly, it is possible to suppress the occurrence of a case where a user easily removes the cylindrical member, and damages or loses the cylindrical member.

What is claimed is:

1. A watch comprising:

a case including a through hole formed in a side surface of the case;

a cylindrical member that is an integral body formed of a first cylindrical portion being threadedly engageable with the through hole and a second cylindrical portion in contact with the side surface of the case and having a recessed housing portion that opens to outside of the case, the cylindrical member including an insertion hole continuously formed with the recessed housing portion;

an operating member including a shaft portion configured to be inserted into the insertion hole of the cylindrical member in a slidable manner, and a head portion being formed at an end portion of the shaft portion and housed in the recessed housing portion; and a sealing member disposed between the case and the second cylindrical portion, wherein an internally drivable engaged portion configured to axially receive a mating tool is formed at an inner peripheral surface of the insertion hole, and the engaged portion is covered by the head portion.

2. The watch according to claim 1 comprising a coil spring through which the shaft portion is inserted, the coil spring being disposed between the second cylindrical portion and the head portion, and configured to bias the operating member toward outside of the case, wherein an inner diameter of the coil spring is larger than an outer diameter of the engaged portion.

3. The watch according to claim 1 comprising a coil spring through which the shaft portion is inserted, the coil spring being disposed between the second cylindrical portion and the head portion, and configured to bias the operating member toward outside of the case, wherein an outer diameter of the coil spring is smaller than an inner diameter of the engaged portion.

4. The watch according to claim 1, wherein the internally drivable engaged portion is a hexalobular hole.

* * * * *